US007173580B2

(12) United States Patent
Weitbruch et al.

(10) Patent No.: US 7,173,580 B2
(45) Date of Patent: Feb. 6, 2007

(54) METHOD FOR OPTIMIZING BRIGHTNESS IN A DISPLAY DEVICE AND APPARATUS FOR IMPLEMENTING THE METHOD

(75) Inventors: Sébastien Weitbruch, Mönchweiler (DE); Cédric Thebault, Villingen-Schwenningen (DE); Carlos Correa, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 545 days.

(21) Appl. No.: 10/744,955

(22) Filed: Dec. 23, 2003

(65) Prior Publication Data

US 2004/0164933 A1 Aug. 26, 2004

(30) Foreign Application Priority Data

Jan. 10, 2003 (EP) ..... 03290062

(51) Int. Cl.
*G09G 3/28* (2006.01)

(52) U.S. Cl. ..... 345/60; 345/63

(58) Field of Classification Search ..... 345/60–68, 345/55, 204, 208, 690; 315/169.1, 169.4
See application file for complete search history.

(56) References Cited

U.S. PATENT DOCUMENTS 5,329,288 A 7/1994 Kim ..... 345/63
5,745,085 A 4/1998 Tomio et al. ..... 345/63
6,388,678 B1 * 5/2002 Kasahara et al. ..... 345/60
6,496,165 B1 12/2002 Ide et al. ..... 345/60
2002/0140636 A1 * 10/2002 Holtslag et al. ..... 345/55

FOREIGN PATENT DOCUMENTS

EP 0 674 303 A2 9/1995
WO WO 02/11111 A2 2/2002

* cited by examiner

*Primary Examiner*—Regina Liang
(74) *Attorney, Agent, or Firm*—Joseph J. Laks; Harvey D. Fried; Patricia A. Verlangieri

(57) ABSTRACT

The invention relates to a method for optimizing brightness in a display device having a plurality of luminous elements corresponding to the pixels of a picture, wherein the time duration of a video frame or video field is divided into a plurality of sub fields during which the luminous elements can be activated for light emission with sustain pulses corresponding to a sub field code word which is used for brightness control, the total number of sustain pulses being determined in view of a selected power mode function of picture load the method including the following steps:

setting a threshold value in relation to the picture load, comparing, for a frame, the number of the current sustain pulse to said threshold value, if the number of the current sustain pulses is below the threshold value, the sustain pulses are generated at a fixed frequency, if the number of the current sustain pulses is above the threshold value, the sustain pulses are generated at an evolving frequency.

This invention applies mainly to PDP and all displays controlled by using a PWM.

7 Claims, 5 Drawing Sheets

METHOD FOR OPTIMIZING BRIGHTNESS IN A DISPLAY DEVICE AND APPARATUS FOR IMPLEMENTING THE METHOD

The invention relates to a method and an apparatus for optimizing brightness in a display device. More specifically, the invention is related to a kind of video processing for improving the picture quality of pictures which are displayed on displays like plasma display panels (PDP) and all kind of displays based on the principle of duty cycle modulation (pulse width modulation) of light emission. The method and the apparatus aim at reducing the EMI (Electro-Magnetic Interference) problems.

BACKGROUND

The plasma display technology now makes it possible to achieve flat colour panels of large size and with limited depth without any viewing angle constraints. The size of the displays may be much larger than the classical CRT picture tubes would have ever been allowed. Referring to the latest generation of European TV sets, a lot of work has been made to improve its picture quality. Consequently, there is a strong demand, that a TV set built in a new technology like the plasma display technology has to provide a picture so good or better than the old standard TV technology. This picture quality can be decomposed in different parameters such as:

- Good response fidelity of the panel: This means that only one pixel could be "ON" in the middle of a black screen and in addition, this panel has to perform a good homogeneity.
- Good brightness of the screen: This is limited by the idle time of the panel, i,e time in which no light is produced.
- Good contrast ratio even in dark room: This is limited by the brightness of the panel combined with the black level.

All these parameters are completely linked together. So an optimised compromise has to be chosen to provide the best quality picture at the end.

A plasma display panel utilizes a matrix array of discharge cells, which could only be "on" or "off". Also unlike a CRT or LCD in which gray levels are expressed by analog control of the light emission, a PDP controls the gray levels by modulating the number of light pulses per frame. The eye will integrate this time-modulation over a period corresponding to the eye time response. Since the video amplitude determines the number of light pulses, occurring at a given frequency, more amplitude means more eye pulses and thus more "on" time. For this reason, this kind of modulation is known as PWM, (for pulse width modulation). To establish a concept for this PWM, each frame will be decomposed in sub-periods called "sub-fields". For producing the small light pulses, an electrical discharge will appear in a gas filled cell, called plasma and the produced UV radiation will excite a coloured phosphor, which emits the light.

In order to select which cell should be lighted, a first selective operation called "addressing" will create a charge in the cell to be lighted. Each plasma cell can be considered as a capacitor, which keeps the charge for a long time. Afterwards, a general operation called "sustain" applied during the lighting period will add charges in the cell. Only in the cells addressed during the first selective operation, the two charges build up and that brings a firing voltage between two electrodes of the cell. UV radiation is generated and the UV radiation excites the phosphorous for light emission. During the whole sustain period of each specific sub-field, the cell will be lighted in small pulses at a given sustain frequency. At the end, an erase operation will remove all the charges to prepare a new cycle. In the standard addressing method known as ADS (Address Display Separated), all the basic cycles are made one after the other. This is represented on FIG. 1 which is an example of ADS based on a 8-bit encoding with only one priming pulse at the beginning of the frame. In that case, the gray level is represented by a combination of the 8 following bits:

1-2-4-8-16-32-64-128

So, the frame period is divided in 8 sub fields, each one corresponding to a bit. The number of light pulses for the bit 2 is the double as for the bit 1 and so forth. So it is possible through sub fields combination to build the 256 gray levels. This is only an example, as the number of sub fields or of priming could be modified in view of the quality factor to improve.

In fact for this type of display, more brightness equals more sustain pulses. This also means more peak luminance. More sustain pulses correspond also to a higher power that flows in the electronic. Therefore, if no specific management is done, the enhancement of the peak luminance for a given electronic efficacy will introduce an increase of the power consumption.

The main idea behind every kind of power management concept associated with peak white enhancement is based on the variation of the peak-luminance depending on the picture content.

The picture introducing the higher power consumption is a full-white picture. Therefore, for a required power consumption and for a given electronic efficacy, the luminance of the full-white is fixed. Then, for all other picture content, the peak-luminance will be adapted to have stable power consumption as shown on FIG. 2. This figure shows the decrease of the luminance when the picture load increases from a peak white picture to a full white picture. More precisely, when a PDP screen displays a full white picture (right screen in FIG. 2), less luminance is needed by the eye to catch a nice impression of luminance since this luminance is displayed on a very large part of the visual field. On the other hand, when a PDP screen displays a picture having low energy (left screen in FIG. 2) the contrast ratio is very important for the eye. In that case, the highest available white luminance should be output on such a picture to enhance the contrast ratio.

Such a concept suits very well to the human visual system, which is dazzled in case of full-white picture whereas it is really sensitive to dynamic in case of dark picture (e.g. dark night with a moon). Therefore in order to increase the impression of high contrast on dark picture, the peak-luminance is set to very high values whereas it is reduced in case of energetic pictures (full-white). This basic principle will lead to a stable power consumption, as represented by the horizontal line in FIG. 2.

In the case of a plasma display, the luminance as well as the power consumption is directly linked to the number of sustain pulses per frame. This has the disadvantage of allowing only a reduced number of discrete power levels compared to an analog system.

In other words, the concept of power management adapted to a PDP is based on the change of the total amount of sustain pulses depending on picture content in order to keep the overall power consumption constant. Such a concept is illustrated on FIG. 3 that shows the number of sustain pulses in relation with the picture load.

In the case of fully digital displays like plasma, only discrete modes can be defined on the curve of FIG. 3 based on a measurement of the picture content or picture load. This measurement, mainly called APL for Average Power Level can be computed as following:

$$APL(I(x, y)) = \frac{1}{(C \times L)} \times \sum_{x,y} I(x, y)$$

where I(x,y) represents the displayed picture having C columns and L lines. The main objective leads in the determination of a discrete number of modes in an optimal manner.

Once the optimal power modes have been defined based on a given number of sustain pulses for various APL values, the distribution of sustain pulses among the sub-field sequence should be performed. On one hand, a high number of sub-fields is mandatory to ensure high quality display with reduced moving artifacts. On the other hand, every addressing operation required for each sub-field corresponds to idle time where no light pulse can be produced. Furthermore, the available sustain frequency is fixed and normally corresponds to an optimal panel functioning to avoid luminance variation depending on picture content.

In other words, in the past, the optimal sustain frequency was fixed for all APL values and set to the optimal value (e.g. 200 kHz in the present example). Obviously, this will reduce the capability of the panel to display high peak luminance for a high number of sub-fields. Therefore, new approaches have been defined in the past in order to reach higher peak-luminance at good panel homogeneity. Some of the solutions are described, for example, in WO00/46782 or WO02/11111 in the name of the applicant. Since high peak luminance is only mandatory for picture having low charge, which also means picture being less sensitive to the homogeneity problems, the optimal sustain frequency is not required there. Therefore the actual state of the art for optimized power management is based on a variation of the sustain frequency for low-charged pictures as shown on FIG. 4 for a 12 sub-fields distribution.

In this example, when the picture load is below 20%, an increase of the sustain frequency will be performed whereas this frequency is fixed for more loaded pictures. Obviously, all the values presented here are only example and should vary for one supplier to another (e.g. the value 20%). Indeed some suppliers keep the same frequency whereas other suppliers have, for every APL value and picture charge, an other sustain frequency.

However, the concept described above presents some limitations such as:

- For a given APL value, the sustain frequency is fixed to a given value, for example 200 KHz at 100% charge and 320 KHz for low charge. There is only a shift of the sustain frequency value. In this case, the EMI (Electro-Magnetic Interference) peak observed at the sustain frequency will also evolve in its position as the sustain frequency. It will stay strong, always requiring a strong filter that decreases the brightness.
- The panel efficacy as well as the voltage margin of the panel depend strongly of the sustain frequency. In other words, if the sustain frequency is too far away from the optimal value, a loss of margin as well as efficiency could happen. Moreover, the impact on the margin and efficacy will be stronger on low sub-fields (LSB) having less energy. In that case, if the APL changes between two pictures having a lot of similarities, changes in the dark areas can be perceptible (the eye is much more sensitive in those regions).

INVENTION

The present invention proposes a new method and an apparatus that solve the above problems.

The present invention relates to a method for optimizing brightness in a display device having a plurality of luminous elements corresponding to the pixels of a picture, wherein the time duration of a video frame or video field is divided into a plurality of sub fields during which the luminous elements can be activated for light emission with sustain pulses corresponding to a sub field code word which is used for brightness control, the total number of sustain pulses being determined in view of a selected power mode function of picture load the method including the following steps:

- setting a threshold value in relation to the picture load,
- comparing, for a frame, the number of the current sustain pulse to said threshold value,
- if the number of the current sustain pulses is below the threshold value, the sustain pulses are generated at a fixed frequency,
- if the number of the current sustain pulses is above the threshold value, the sustain pulses are generated at an evolving frequency.

In the invention, the threshold value is set at a number of sustain pulses corresponding to a given percentage of the APL (Average Power Level) of a full white picture. The selected number is such that every picture presents a perfect homogeneity. Moreover, the fixed frequency corresponds to the optimal sustain frequency which gives a stable panel behavior and the evolving frequency will increase progressively following a linear progression or other types of progressions such as a progression using a multiplying factor.

The invention also consists in an apparatus for carrying out the inventive method. The apparatus comprises at least an average picture power measuring circuit, a sub field coding unit and a power level control unit storing a table of power level mode, said apparatus further comprising a counter for counting the actual number of the sustain pulses and means for comparing the actual number to the threshold value and for modifying the length of said sustain pulses according to the progression function used.

DRAWINGS

Exemplary embodiments of the invention are illustrated in the drawings and are explained in more detail in the following description.

FIG. 1, already described, shows a classical ADS addressing scheme for a PDP inclusive priming;

FIG. 2, already described, illustrates the typical power management control system in a PDP;

FIG. 3, already described, is a curve giving the number of sustain pulses function of the picture load or picture content used in a classical concept of power management on PDP;

FIG. 4, already described, represents a sustain frequency controlling method according to the state of the art;

EXEMPLARY EMBODIMENTS

The method of the present invention will be described with reference to a PDP using an ADS addressing method as described above with a sub field organization of 12 sub fields. This sub field organization is only an example, other organizations known from the literature with e.g. more sub fields and/or different sub fields weights may be used for improving the picture quality.

The method of the present invention also uses a power control method as described for example in WO00/46782 in the name of Thomson Licensing S.A. This method determines the number of sustain pulses as a function of the average picture power, i.e. it switches between different modes with different power levels. The total number of sustain pulses depends on the measure of the Power Level Enhancement (PLE) or of the Average Power Level (APL) for a given picture. So for a full white picture, the number of sustain pulses is low and for a peak white picture the number of sustain pulses is high for the same power consumption.

The method is also based on the fact that the duration of each sustain pulse determines the quantity of sustain pulses which can be made per frame period depending on the time which stays free for sustaining. This also determines the frequency of the sustain pulses. Generally, there is a minimum for the sustain pulse duration to ensure a good sustain operation enabling a good panel response fidelity. The rest of the sustain duration constitutes a margin which can be used to adjust the sustain frequency to the panel behavior. In fact, each panel will have a domain in which its behavior is quite stable. A stable panel behavior is obtained for a certain sustain frequency or optimal sustain frequency which is in fact lower than the frequency required to achieve a maximum peak white but gives a homogeneous picture rendition (high charged line and low charged line will have the same luminance).

So, based on the above features, the method of the present invention consists, first of all, in setting a threshold value in relation to the picture load. The threshold value is in fact an amount of sustain pulses corresponding to a certain percentage of picture load. This percentage corresponds to the limit of picture load having a perfect homogeneity. In fact, for a given panel and for a given display mode (i.e. 50 Hz, 60 Hz . . . ), the threshold value is fixed and may be stored in a table in the PDP control IC. A practical example will be given hereafter.

Figure 5:
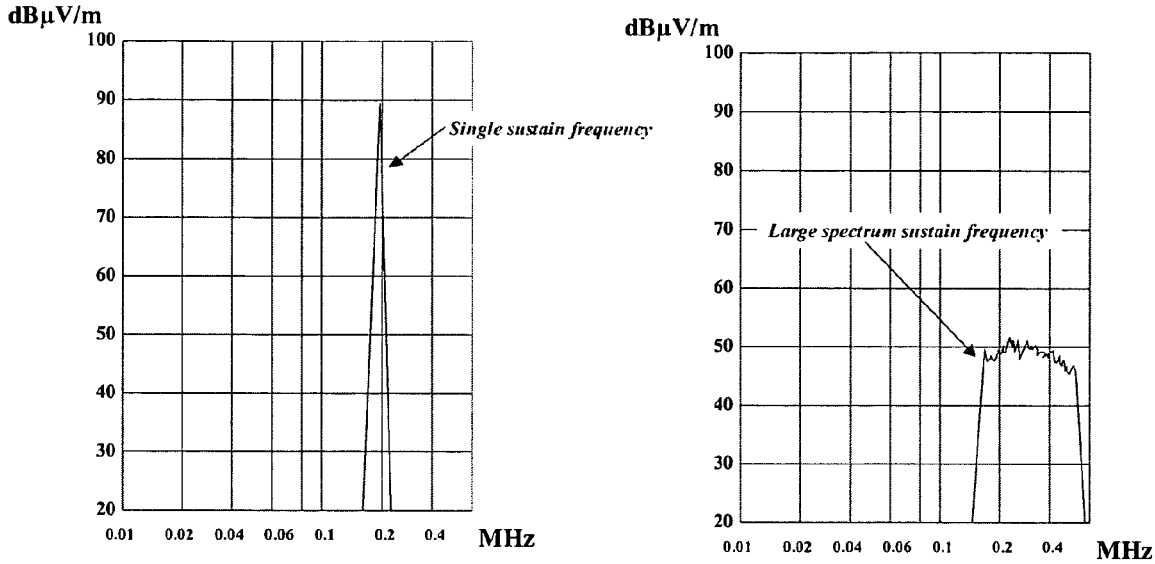
FIG. 5 represents two curves showing the EMI sustain amplitude, one for a classical concept and the other in the case of using the present invention.

Once the threshold value set, the method consists in comparing, for a frame, the number of the current sustain pulses to said threshold value and if said number is below the threshold value, generating the sustain pulses at a fixed frequency or if said number is above, generating the sustain pulses at an evolving frequency. So, the sustain frequency for high charged pictures such that pictures corresponding to an APL between 100% and 75% for instance, should stay at the optimal value, while for the low charged picture below 75%, the sustain frequency is increasing, replacing the previous sustain peak with high amplitude by a larger spectrum at lower amplitude as shown on FIG. 5. The FIG. 5 clearly shows that the utilization of a variable sustain frequency for pictures having a high peak luminance leads to a reduction of the amplitude of the EMI (Electro Magnetic Interference) radiation. The energy spread is the same but spread on a larger amount of frequencies; so it is less disturbing. Consequently a higher brightness is obtained without the problem of EMI.

Practically, the implementation of the concept uses a count of the number of sustains, to decide of the length of the new sustain operation to be performed.

For that purpose, a variable S corresponding to the actual sustain number is defined. For instance, the first sustain pulse of the first sub-field will have the position 1 (S=1) whereas the last sustain pulse of the last sub-field will have the position M (S=M) where M represents the total amount of sustain pulses displayed in the current frame.

Then, the length of the sustain pulse (frequency) will depend on this value S.

The relation between this duration and the value S will compute based on the following information:

- Limit C corresponding to the threshold value for high charged pictures: if S<C, then the sustain pulse duration is set to the optimal one. This should limit any problem of load as explained above.
- How many time is available for sustain operation (depending on the addressing speed, the number of subfields . . . ) and how many sustain pulses should be used for peak-white picture (low charged one).

Depending on this information, the length of the sustain pulse can be computed as shown in the next example.

This example will be described in reference to a panel addressed using an ADS method with a sub field organization of 12 sub fields, wherein the optimal or stable sustain frequency is at 200 kHz. In addition, the following values will be used as an example, knowing that other values could also be used since they depend on the panel technology;

The threshold value C is equal to 500, the maximal number of sustain pulses for a peak white is equal to 2000, the available time for sustain operation is 4 ms. Then, the 500 first sustain pulses will have an optimal duration of 2.5 μs corresponding to the optimal working frequency of 200 kHz. The time required for these 500 first sustain pulses is 1250 μs, so 1750 μs are free for the 1500 other sustain pulses.

According to the method of the present invention, various progression can be defined for the evolving frequency:

Linear: $S_n = S_{n-1} - k(k>0)$

With multiplying factor: $S_n = S_{n-1} \times k(k<1)$

Various other progressions can be found and the example will be limit to the linear one.

Then, the following equation has to be solved:

$$\sum_{i=1}^{i=1500} S_i = 2750$$

with $S_1=2.5$ and $S_n=S_{n-1}-k$.

Figure 7:
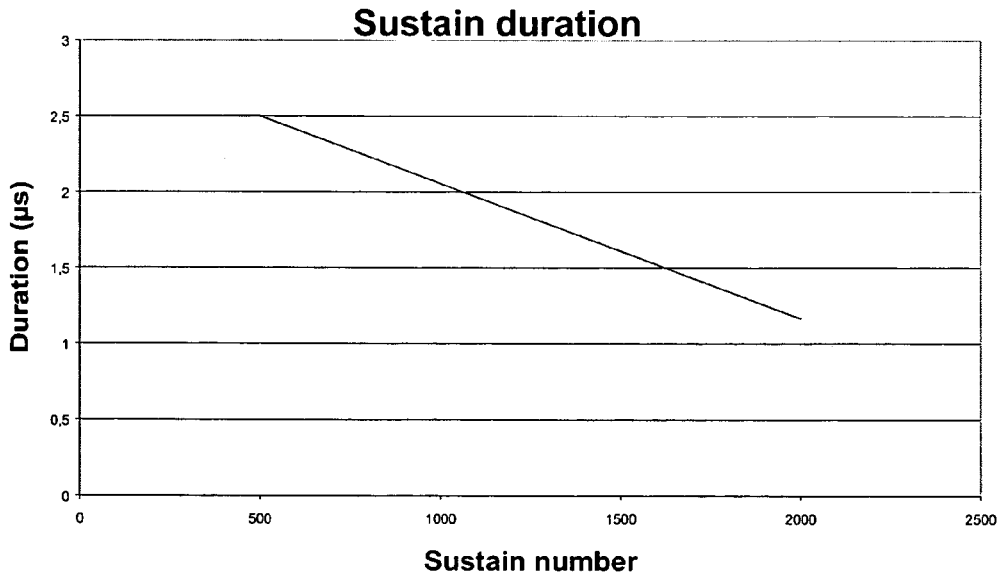
FIG. 7 is a curve representing the evolving of the sustain pulses according to one embodiment of the present invention.
Figure 6:
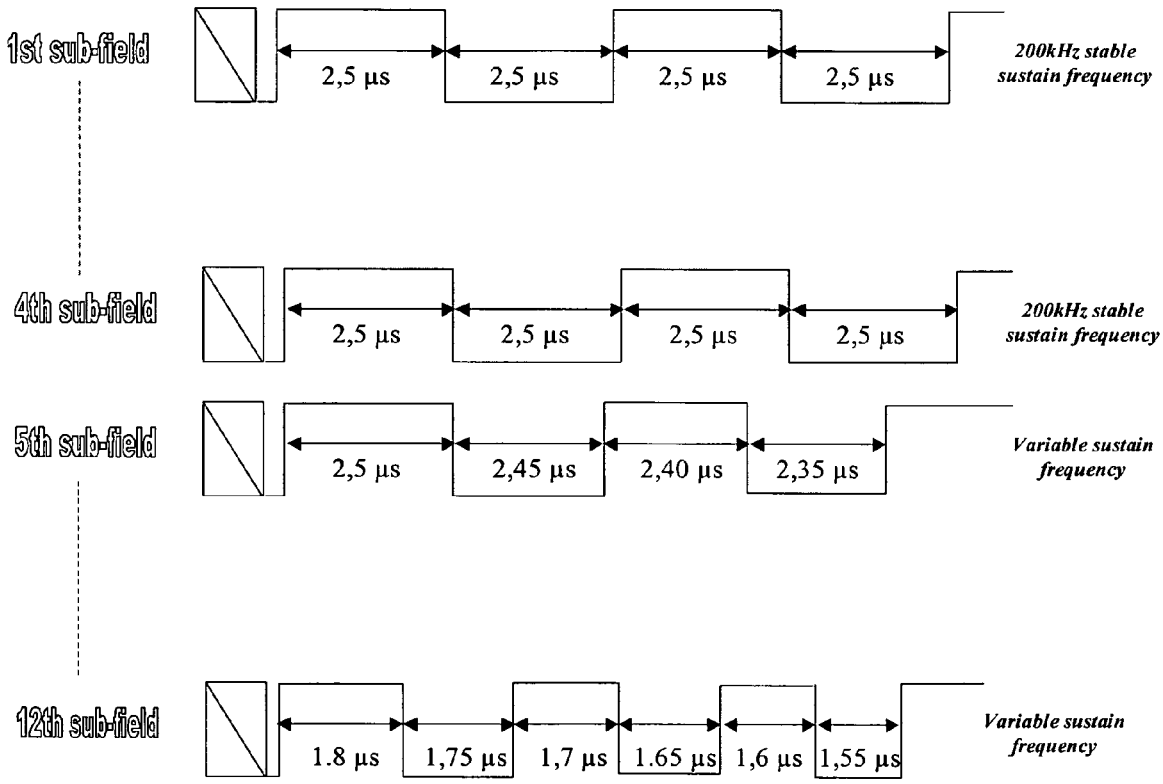
FIG. 6 represents the sustain frequency controlling method according to one embodiment of the present invention.

So, $$\sum_{i=1}^{i=1500} S_i = 1500 \cdot S - k(1+2+3+\ldots+1500)$$
$$= 1500 \cdot S - k \cdot 1125750$$
$$= 2750.$$

giving: k=0.000889 μs. The curve of FIG. 7 represents this result while FIG. 6 represents the evolution of the sustain pulse duration for each sub field according to the present example. In this figure the 4th lowest sub fields have a fixed sustain pulse duration of 2.5 μs and the 8th following sub fields have an evolving sustain pulse duration from 2.5 μs to 1.16 μs.

In the case of a linear progression, only a counter is required the following algorithm is used:

```
If (currentSustainNumber<500)
{
    CurrentSustainDuration = 2.5 μs.
}
Else
{
    CurrentSustainDuration=PreviousSustainDuration − k;
    PreviousSustainDuration=CurrentSustainDuration;
}
```

The advantage of this concept is to dispose of a stable and optimized sustain frequency for high charged picture (low number of sustain pulses) which are the most critical pictures for homogeneity.

On the other side, the duration of the sustain signal is going from 2.5 μs down to 1.16 μs enabling a large spread of the frequency from 200 kHz (2.5 μs) up to 430 kHz (1.16 μs).

Figure 8:
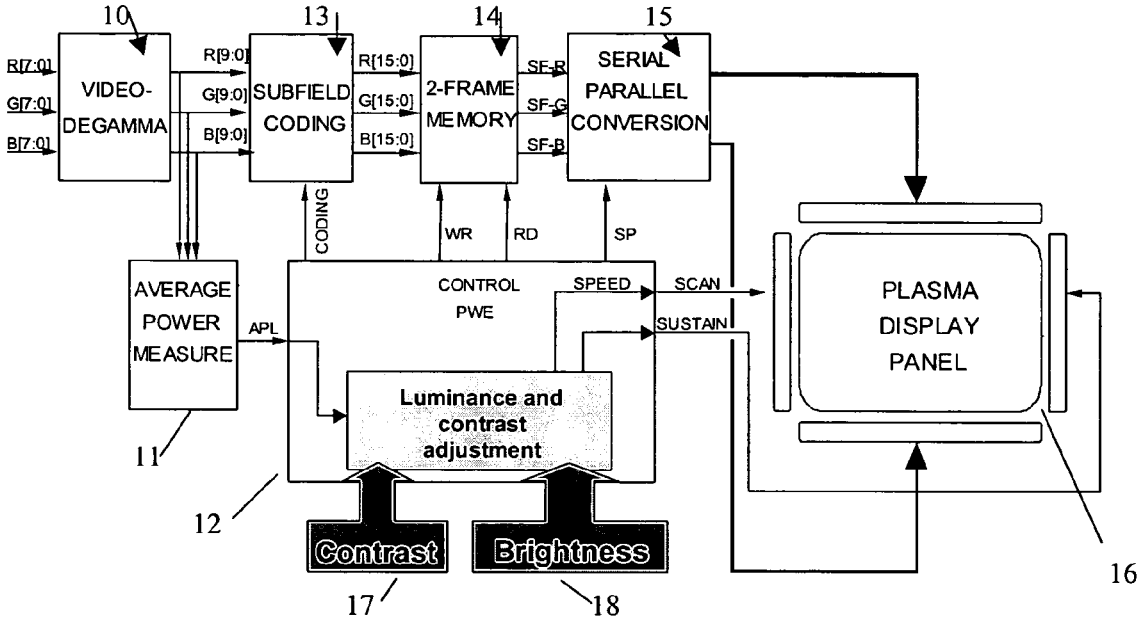
FIG. 8 represents schematically an apparatus for carrying out the sustain frequency controlling method according to the present invention.

In FIG. 8 a block diagram of a circuit implementation for the above explained method is shown. RGB data from a video degamma block 10 is analysed in the average power measure block 11 which gives the computed average power value APL to the PWE control block 12. The average power value of a picture can be calculated by simply summing up the pixel values for all RGB data streams and dividing the result through the number of pixel values multiplied by three, using the following formula $$APL = \frac{1}{3 \cdot M} \cdot \sum_{m=1}^{m=M} (R_m + G_m + B_m)$$

where M represents the total amount of pixels. Information on the contrast level and brightness level settings from the user are also sent to the block 12 as represented by the blocks 17 and 18

The control block 12 consults its internal power level mode table located, for example in a LUT (for Look Up Table). It directly generates the selected mode control signals for the other processing blocks. It selects the sustain table and the sub field encoding table to be used.

The sub-field coding process is done in the sub-field coding unit 13. Here to each pixel value a sub-field code word is assigned. In a simple embodiment, there may be a table for each mode so that the assignment is made with this table. Ambiguities can be avoided in this way.

The PWE control block 12 also controls the writing WR of RGB pixel data in the frame memory 14, the reading RD of RGB sub-field data SF-R, SF-G, SF-B from the second frame memory 14, and the serial to parallel conversion circuit 15 via control line SP. It generates the SCAN and SUSTAIN pulses required to drive the driver circuits for PDP 16. In that case, the length of the addressing signal (addressing speed) will be taken from the LUT for each line of the panel.

Note that an implementation can be made with two frame memories. Data is written into one frame memory pixel-wise, but read out from the other frame memory sub-field-wise. In order to be able to read the complete first sub-field a whole frame must already be present in the memory. This calls for the need of two whole frame memories. While one frame memory is being used for writing, the other is used for reading, avoiding in this way reading the wrong data.

Then, depending on the sustain table activated in function of the brightness, contrast and APL value, various number of sustain pulses per sub field will be used. An internal counter provided in the control block and reset at the beginning of each frame, will count during the sustain operation, the actual number of sustain pulses used. Depending on the value C and k previously defined, the appropriate length of the signal is computed and used to control the plasma panel through the SUSTAIN signal.

The whole computation of all parameters will be made one time for a given panel technology and then stored in the memory or LUT of the plasma panel dedicated IC.

Figure 1:
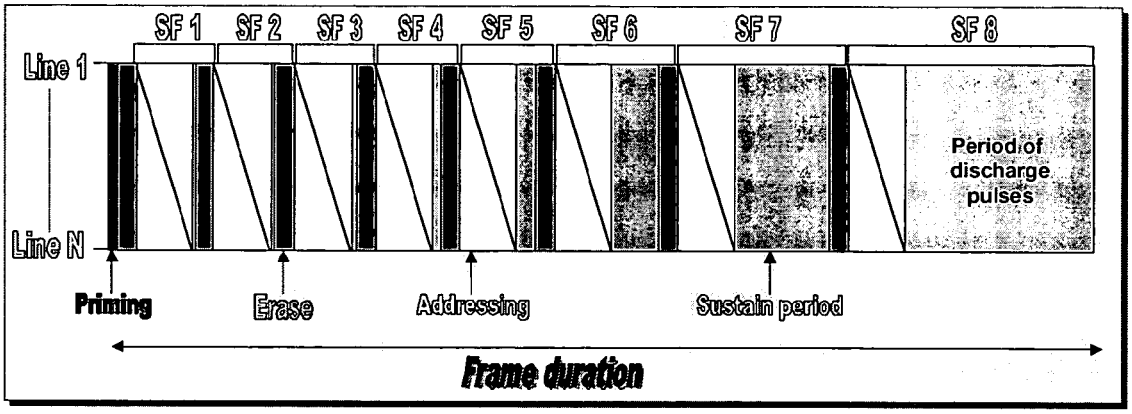
Figure 2:
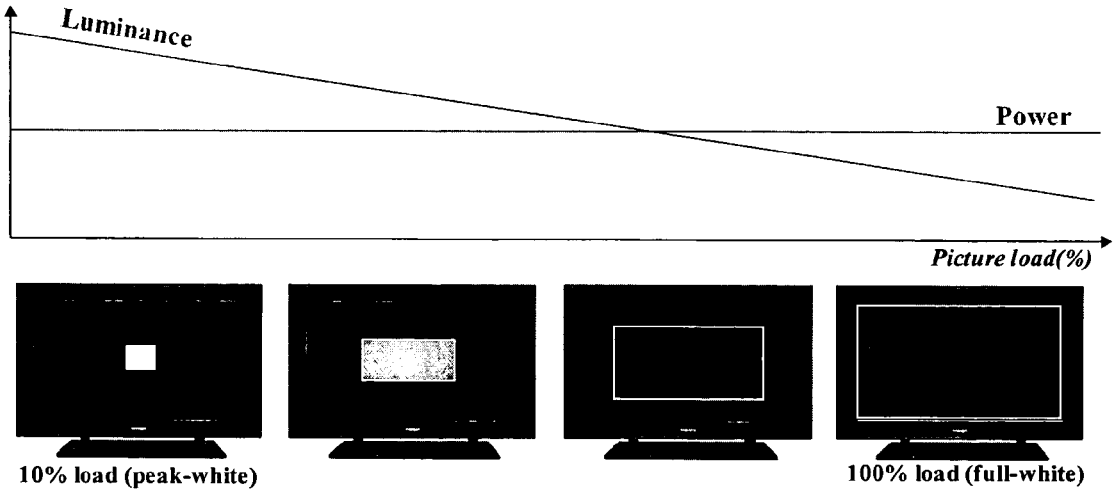
Figure 3:
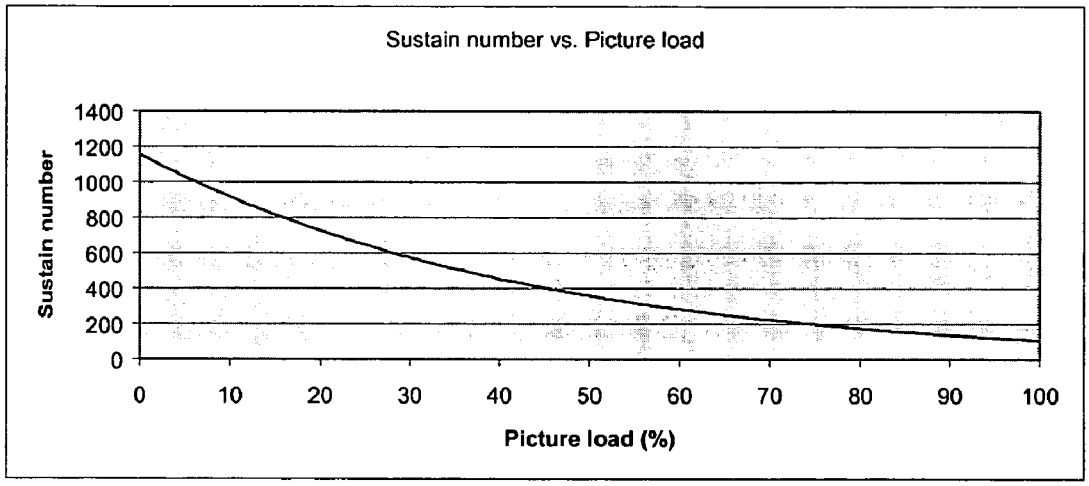
Figure 4:
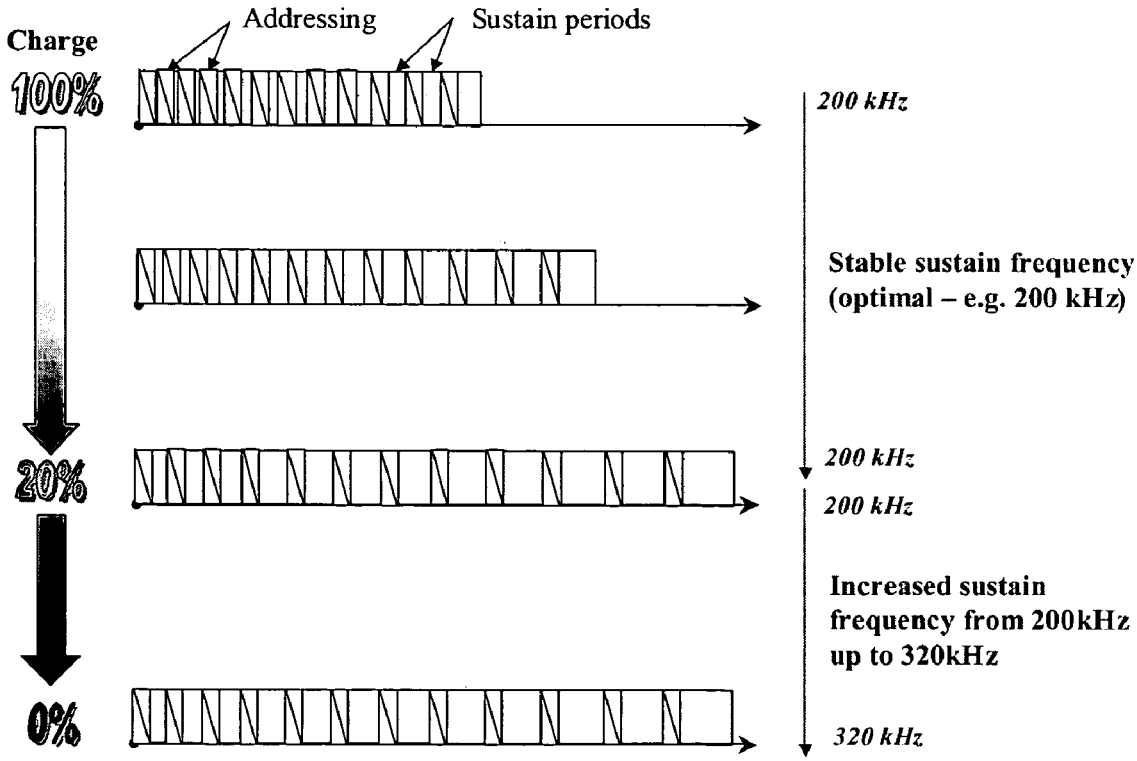

The blocks shown in FIG. 4 can be implemented with appropriate computer programs rather than with hardware components.

The invention is not restricted to the disclosed embodiments. Various modifications are possible and are considered to fall within the scope of the claims.

The invention can be used for all kinds of displays which are controlled by using a PWM like control of the light emission for grey-level variation.

What is claimed is:

1. A method for optimizing brightness in a display device having a plurality of luminous elements corresponding to the pixels of a picture, wherein the time duration of a video frame or video field is divided into a plurality of sub fields during which the luminous elements can be activated for light emission with sustain pulses corresponding to a sub field code word which is used for brightness control, the total number of sustain pulses being determined in view of a selected power mode function of picture load the method including the following steps:

setting a threshold value in relation to the picture load, comparing, for a frame, the number of the current sustain pulse to said threshold value, if the number of the current sustain pulses is below the threshold value, the sustain pulses are generated at a fixed frequency, if the number of the current sustain pulses is above the threshold value, the sustain pulses are generated at an evolving frequency.

2. Method according to claim 1, wherein the threshold value is set at a number of sustain pulses corresponding to a given percentage of the APL (Average Power Level) of a full white picture.

3. Method according to claim 1, wherein the fixed frequency corresponds to the optimal sustain frequency which gives a stable panel behavior.

4. Method according to claim 1, wherein the evolving frequency will increase progressively following a progression.

5. Method according to claim 4, wherein the progression is a linear progression.

6. Method according to claim 4, wherein the progression is a mathematical progression such as a progression using a multiplying factor.

7. Apparatus comprising at least an average picture power measuring circuit, a sub field coding unit, the average picture power measuring circuit and the sub field coding unit receiving video signal from a video degamma circuit, and a power level control unit storing a table of power level mode, and receiving information from the average picture power measuring circuit for selecting the power level mode, wherein the power level control unit comprises a counter for counting the actual number of sustain pulses to be sent to a display panel and means for comparing the actual number to a threshold value and for modifying the length of said sustain pulses according to the progression function used.

* * * * *